US011691655B2

(12) United States Patent
Lata et al.

(10) Patent No.: US 11,691,655 B2
(45) Date of Patent: Jul. 4, 2023

(54) PLANNING OF MAINTENANCE OF RAILWAY

(71) Applicant: KONUX GMBH, Munich (DE)

(72) Inventors: Vlad Lata, München Bayern (DE); Chrisopther Boucher, Zolling (DE); Thomas Böhm, Schwerin (DE)

(73) Assignee: KONUX GMBH, Munich (DE)

( * ) Notice: Subject to any disclaimer, the term of this patent is extended or adjusted under 35 U.S.C. 154(b) by 0 days.

(21) Appl. No.: 17/255,636

(22) PCT Filed: Jun. 17, 2019

(86) PCT No.: PCT/EP2019/065831

§ 371 (c)(1),
(2) Date: Dec. 23, 2020

(87) PCT Pub. No.: WO2020/002017

PCT Pub. Date: Jan. 2, 2020

(65) Prior Publication Data

US 2021/0261177 A1 Aug. 26, 2021

(30) Foreign Application Priority Data

Jun. 28, 2018 (EP) ..... 18180472

(51) Int. Cl.
*B61L 15/00* (2006.01)
*B61L 27/53* (2022.01)
*B61L 27/57* (2022.01)

(52) U.S. Cl.
CPC ..... *B61L 15/0081* (2013.01); *B61L 27/53* (2022.01); *B61L 27/57* (2022.01)

(58) Field of Classification Search
CPC ..... B61L 27/57; B61L 27/53; B61L 15/0081
(Continued)

(56) References Cited

U.S. PATENT DOCUMENTS 5,978,717 A * 11/1999 Ebersohn ..... B60L 3/12 701/19
2003/0201368 A1 10/2003 McQuistian
(Continued)

FOREIGN PATENT DOCUMENTS

CN 202243555 U 5/2012
CN 104182796 A 12/2014
(Continued)

OTHER PUBLICATIONS

International Search Report dated Aug. 21, 2019 for corresponding International Application No. PCT/EP2019/065831.
(Continued)

*Primary Examiner* — Aditya S Bhat
(74) *Attorney, Agent, or Firm* — Tarolli, Sundheim, Covell & Tummino L.L.P.

(57) ABSTRACT

The present invention relates to a method for automatically planning maintenance in railway, the method comprising the steps of determining maintenance for different assets at different locations comprising determining at least one of a predicted technical condition of an asset and automatically optimizing the planning accordingly. Further, a railway planning system for automatically planning maintenance comprising a determining component for determining maintenance for different assets at different locations comprising a determining component for determining at least one of a predicted technical condition of an asset and an optimization component for automatically optimizing the planning accordingly.

17 Claims, 2 Drawing Sheets

(58) Field of Classification Search
USPC ..... 702/34
See application file for complete search history.

(56) References Cited

U.S. PATENT DOCUMENTS

| | | | | |
|---|---|---|---|---|
| 2014/0200827 | A1* | 7/2014 | Bhattacharjya ..... | G06Q 10/06 702/34 |
| 2014/0200873 | A1* | 7/2014 | Fang ..... | B61L 27/53 703/8 |

FOREIGN PATENT DOCUMENTS

| | | | |
|---|---|---|---|
| CN | 104908781 | A | 9/2015 |
| CN | 105564465 | A | 5/2016 |
| EP | 2862778 | A1 | 4/2015 |
| JP | 2005157793 | A | 6/2005 |
| JP | 4832609 | B | 9/2011 |
| JP | 2015040417 | A | 3/2015 |
| JP | 2015130019 | A | 7/2015 |
| JP | 2015193359 | A | 11/2015 |
| JP | 2016203931 | A | 12/2016 |
| JP | 2016218728 | A | 12/2016 |
| JP | 2017004345 | A | 1/2017 |
| WO | 2012047529 | A1 | 4/2012 |
| WO | 2017215777 | A2 | 12/2017 |

OTHER PUBLICATIONS

JP Office Action.
Summary of Reasons for Rejection; delivery date Feb. 22, 2022 for Patent App. No. 2020-569853; Japanese Patent Application No. 2018-541426.
JP Notice of Reasons for Rejection dated Sep. 6, 2022 for corresponding JP application No. 2020-569853.
JP Decision of Refusal dated Apr. 20, 2023 and English translation thereof, for corresponding JP Application No. 2020-569853.

* cited by examiner

PLANNING OF MAINTENANCE OF RAILWAY

RELATED APPLICATIONS

The present application is a U.S. National Stage application under 35 USC 371 of PCT Application Serial No. PCT/EP2019/065831, filed on 17 Jun. 2019; which claims priority from EP Patent Application No. 18180472.5, filed 28 Jun. 2018, the entirety of both of which are incorporated herein by reference.

FIELD

The invention relates to the planning and control of maintenance routes in railway. It is particularly directed to the optimization of the routes for maintaining railway components. Actual defects, maintenance and/or repair jobs and predicted defects or failures are taken into account. Past experiences, prediction and actual situations can be taken in order to plan, change and monitor the actual, next and further next routes.

BACKGROUND

Railroad, railway or rail transport has been developed for transferring goods and passengers on wheeled vehicles on rails, also known as tracks. In contrast to road transport, where vehicles run on a prepared flat surface, rail vehicles (rolling stock) are directionally guided by the tracks on which they run. Tracks commonly consist of steel rails, installed on ties or sleepers and ballast, on which the rolling stock, usually provided with metal wheels, moves. Other variations are also possible, such as slab track, where the rails are fastened to a concrete foundation resting on a subsurface. An alternative are maglev systems etc.

Rolling stock in a rail transport system generally encounters lower frictional resistance than road vehicles, so passenger and freight cars (carriages and wagons) can be coupled into longer trains. Power is provided by locomotives which either draw electric power from a railway electrification system or produce their own power, usually by diesel engines. Most tracks are accompanied by a signaling system. Railways are a safe land transport system when compared to other forms of transport and is capable of high levels of passenger and cargo utilization and energy efficiency, but is often less flexible and more capital-intensive than road transport, when lower traffic levels are considered.

The inspection of railway equipment is essential for the safe movement of trains. Many types of defect detectors are in use today. These devices utilize technologies that vary from a simplistic paddle and switch to infrared and laser scanning, and even ultrasonic audio analysis. Their use has avoided many rail accidents over the past decades.

Railways must keep up with periodic inspection and maintenance in order to minimize effect of infrastructure failures that can disrupt freight revenue operations and passenger services. Because passengers are considered the most crucial cargo and usually operate at higher speeds, steeper grades, and higher capacity/frequency, their lines are especially important. Inspection practices embrace car inspection or walking inspection. Curve maintenance especially for transit services includes gauging, fastener tightening, and rail replacement.

Rail corrugation is a common issue with transit systems due to the high number of light-axle, wheel passages that result in grinding of the wheel/rail interface. Since maintenance may overlap with operations, maintenance windows (nighttime hours, off-peak hours, altering train schedules or routes) must be closely followed. In addition, passenger safety during maintenance work (inter-track fencing, proper storage of materials, track work notices, hazards of equipment near states) must be regarded at all times. Moreover, maintenance access problems can emerge due to tunnels, elevated structures, and congested cityscapes. Here, specialized equipment or smaller versions of conventional maintenance gear are used.

Unlike highways or road networks where capacity is disaggregated into unlinked trips over individual route segments, railway capacity is fundamentally considered a network system. As a result, many components can cause system disruptions. Maintenance must acknowledge the vast array of a route's performance (type of train service, origination/destination, seasonal impacts), line's capacity (length, terrain, number of tracks, types of train control), trains throughput (max speeds, acceleration/deceleration rates), and service features with shared passenger-freight tracks (sidings, terminal capacities, switching routes, and design type).

Railway inspection is used for examining rail tracks for flaws that could lead to catastrophic failures. According to the United States Federal Railroad Administration Office of safety analysis track defects are the second leading cause of accidents on railways in the United States. The leading cause of railway accidents is attributed to human error. Every year, North American railroads spend millions of dollars to inspect the rails for internal and external flaws. Non-destructive testing (NDT) methods are used as a preventative measure against track failures and possible derailment.

With increased rail traffic at higher speeds and with heavier axle loads today, critical crack sizes are shrinking and rail inspection is becoming more important. In 1927, magnetic inductions had been introduced for the first rail inspection cars. This was done by passing large amounts of magnetic field through the rail and detecting flux leakage with search coils. Since then, many other inspection cars have traversed the rails in search of flaws.

There are many effects that influence rail defects and rail failure. These effects include bending and shear stresses, wheel/rail contact stresses, thermal stresses, residual stresses and dynamic effects. Defects due to contact stresses or rolling contact fatigue (RCF) can be tongue-lipping, head-checking (gauge corner cracking) as well as squats (which start as small surface breaking cracks).

Other forms of surface and internal defects can be corrosion, inclusions, seams, shelling, transverse fissures and/or wheel burn.

One effect that can cause crack propagation is the presence of water and other liquids. When a fluid fills a small crack and a train passes over, the water becomes trapped in the void and can expand the crack tip. Also, the trapped fluid could freeze and expand or initiate the corrosion process.

Parts of a rail where defects can be found is the head, the web foot, switchblades, welds, bolt holes etc. A majority of the flaws found in rails are located in the head, however, flaws are also found in the web and foot. This means that the entire rail needs to be inspected.

Methods that are presently used to detect flaws in rails are ultrasound, eddy current inspection, magnetic particle inspection, radiography, magnetic induction, magnetic flux leakage and electric acoustic transducers.

The techniques mentioned above are utilized in a handful of different ways. The probes and transducers can be utilized on a "walking stick", on a hand pushed trolley, or in a hand-held setup. These devices are used when small sections of track are to be inspected or when a precise location is desired. Many times these detail oriented inspection devices follow up on indications made by rail inspection cars or rail trucks. Handheld inspection devices are very useful for this when the track is used heavily, because they can be removed relatively easy. However, they are considered very slow and tedious, when there are thousands of miles of track that need inspection. Moreover, first indications of the defects can be only detected rather late.

There are many approaches of road/rail inspection trucks. Those are almost all-ultrasonic testing exclusively, but there are some with the capability to perform multiple tests. These trucks are loaded with high-speed computers using advanced programs that recognize patterns and contain classification information. The trucks are also equipped with storage space, tool cabinets, and workbenches. A GPS unit is often used with the computer to mark new defects and locate previously marked defects. The GPS system allows a follow up car to find precisely where the lead vehicle detected the flaw. One advantage to such trucks is that they can work around regular rail traffic without shutting down or slowing down entire stretches of track. However, because railroad management frequently orders those trucks to be used to inspect tracks at speeds over 50 mph (80 km/h), tracks reported as having been inspected are, in fact, not inspected. Reference is made to Wikipedia in March 2018 under the keywords "Rail transport" and "Rail inspection".

With increased rail traffic carrying heavier loads at higher speeds, a quicker more efficient way of inspecting railways is needed. Besides that, also the control of the train-rail interaction would be advantageous; i.e., checking the load, improper loads, load-dependent fees for trains on railroads as high loads increase wear of the railroads, surveillance of the maintenance of trains or future failure thereof etc.

EP 2 862 778 A1 relates to a method for generating measurement results from sensor signals generated by one or more separate sensors. The signals comprise two or more data points from the same event, the sensors each being arranged at a rail configured to carry a rail vehicle. The sensors are configured to measure a physical property of the rail. The sensors each comprise a transmitter configured to transmit sensor signals to a physically distanced data management arrangement. The physically distanced data management arrangement comprises a receiver configured to receive sensor signals, a processor configured to evaluate sensor signals, and a memory. The method comprises the steps of receiving sensor signals and evaluating sensor signals. The data management arrangement stores the received sensor signals in the memory and the evaluation comprises a step of combining and/or comparing at least two data points from one or more stored sensor signals with each other. The document further addresses evaluation of sensor signals by comparing and or combining data points from sensor signals. Thereby a plurality of different measurement results can be allegedly calculated from sensor signals.

The measurements of such sensors can be taken to determine spots for maintenance or repair or predicted maintenance or repair.

Attempts have been made to plan such maintenance or repair works.

In U.S. Pat. No. 5,978,717 track maintenance management is defined as the integration of all the maintenance engineering tasks which ensure that optimum levels of availability and overall performance of the track infrastructure. This prior art provides the tools for effective track maintenance management and ensures that an economic balance between resource input and condition of the track infrastructure is maintained while still providing a competitive transport service. This document incorporates an essential database and a means of keeping it current and also provides a means for visualizing and interrelating the sets of data to improve maintenance decisions. The prior art also represents track condition by moving calculation which helps identify problems areas.

All these documents are herein incorporated by reference.

SUMMARY

It is an object of the present invention to provide an improved or alternative system and method for planning of maintenance of a railway infrastructure.

This object is attained with the embodiments in accordance with the present specification and/or subject matter in accordance with the embodiments and/or claims.

According to the present invention permanent and/or continuous and/or regular measurements can be taken about vertical movement, vibration, rolling stock speed, rolling stock type, weather, initial condition and combine them for condition monitoring and predictive maintenance strategies which had not been done before.

The subject matter of the present invention allows the supervision of a highly complex railway infrastructure and to unveil maintenance necessities for a wide range of reasons: a local vicinity of components of the railway infrastructure can be advantageously coordinated. However, also the same or similar type of components located far apart can be detected by the invention and thus maintenance actions can be initiated or coordinated in dependency of the analyses as disclosed below and above.

The subject matter of the present invention relates to a method and system for automated planning of maintenance measures based on data derived from a railway environment. The method can comprise the steps of capturing at least one signal from at least one sensor applied to railway infrastructure.

The expression "sensor" can comprise at least one device, module, model and/or subsystem whose purpose is to detect parameters and/or changes in its environment and provides a respective signal to other devices. Parameters can be length, mass, time, current, electric tension, temperature, humidity, luminous intensity and any parameters derived therefrom such as acceleration, vibration, speed, time, distance, illumination, images, gyroscopic information, acoustics, ultra-sound, air pressure, magnetism, electro-magnetism, position, optical sensor information etc.

Such an intervention can further be initiated by an operating instance.

In this invention, "maintenance" is understood to be any repair, intervention, replacement, renewal, removal, modernizing or manipulation of railway related infrastructure.

Such maintenance can be initiated predictively. The term "prediction" (or predicting) is intended to mean predictive analytics that encompasses a variety of statistical techniques from predictive modelling, machine learning, and data mining that analyze current and historical facts to make predictions about future or otherwise unknown events.

A predictive maintenance may be triggered if an appropriate sensor detects changes of properties. As an example, if some light source shows irregularities, this may indicate a soon breakdown of the light source. To further exemplify an application, where a sound sensor may detect irregular sound emission of a wheel although an earlier sensor data has supplied data within the tolerance, this may indicate a failure in the railway infrastructure between those two mentioned sensors.

The railway related infrastructure may be any fixed or movable device that supports the fluent, efficient and safe operation of a railway network. Further, to some extent, the rolling stock may be surveilled, because irregularities of the rolling stock may cause enhanced abrasion to the rails, the sleepers, the switches, the contact wire, just to exemplify some effects. An insufficiently released brake that possibly increases temperature to an axis or a wheel may even constitute a hazard situation that in any case should be prevented.

The maintenance usually can be scheduled with or without the support by machines and/or tools. Even a robot may be configured to carry out limited maintenance measures. In railway related application, maintenance can mean the necessity to cover distances that can be considerable. The initiation of a maintenance measure may therefor have the need to be well organized. If a tool travels to a site where a device must be replaced, it would be advisable to also replace a light source in the vicinity that does not yet show irregularities as described above. It may be a good idea to replace the light source precautionarily to prevent the later necessity to again travel to that location when the light source actually needs replacement because of a failure. It should be clear that the above and below examples are provided for exemplifying situations where a combination of repair—or rather maintenance measures may be advantageous and/or more cost efficient.

Tool, spare parts and/or machine resources are usually limited. Thus, a clear and highly efficient maintenance planning and control appears desirable.

Although senior specialists to some extent can control such maintenance measures by experience, the likelihood that some rarely to be executed measures may be forgotten or may not be seen in their relevance or efficiency.

The subject matter of the invention discloses a method to automatically control the employment of maintenance resources, like machines, spare parts and/or tools. Various sensors contribute their read-outs to local and/or centralized server(s). With the help of machine learning and artificial intelligence (AI) a method is disclosed that can optimize the limited resources for a mission planning. However, the method further can allow manual intervention and/or manual pre-definition of priorities. As an example, a snow-plough may be needed in case of a sudden snow storm where an operator knows better than a machine where to find a suitable device that may not be available under normal conditions but in case of an emergency or necessity. The machine can after this manual intervention coordinate the resources needed and further propose other maintenance that may be suitable en-route.

The one or a plurality of sensor(s) may contribute different signals from different sensors, each sensor, of the same kind or another sensor of a different kind to a centralized or decentralized analytical system.

The analytical data can be of different kind. Further different analytical data stemming from the same or further sensors can be further obtained. The present invention can comprise the further step of capturing at least one, preferably a plurality of further signals from further sensors.

A method for automatically planning maintenance in railway is disclosed that can comprise the steps of determining maintenance for different assets at different locations. A technical condition of an asset that can derive from a prediction system can be used to automatically optimize the planning in accordance with the determinations of the prediction(s).

The optimization of the planning may be accomplished by any of the current or predicted criteria, like a technical condition of an asset, a degrading effect of a train, traffic load information of rolling stock, maintenance effectiveness metrics and/or weather information.

Any combination of the current or predicted criteria may apply and be taken into account accordingly.

The expression "rolling stock" can comprise any vehicle(s) moving on a railway, wheeled vehicles, powered and unpowered vehicles, such as for example, locomotives, railroad cars, coaches, wagons, construction site vehicles, draisines and/or trolleys.

The method according to the invention can be based on the determination of maintenance information for different assets that can be gathered from signals from sensors.

The method can further comprise gathered information from at least one sensor, wherein the information can be based on an analytical approach. The term "analytical approach" is intended to comprise any analytical tool that is used to analyze signals or data. Non-limiting examples are digital analytical methods, such as filter processing, pattern recognition, statistical analytics, probabilistic analytics, statistical models, principle component analysis, ICA, dynamic time warping, maximum likelihood estimates, modeling, estimating, machine learning, supervised learning, unsupervised learning, reinforcement learning, neural network, convolutional network, deep convolutional network, deep learning, ultra-deep learning, genetic algorithms, Markov models, hidden Markov models, Bayesian scores etc. These analytical methods can be applied alone or any combination thereof, sequentially and/or in parallel. Different analytical approaches can thus be different in the kind of one or more analytical method(s) and/or just the order of a plurality of analytical methods when even using the same methods but just in a different order.

The method further can comprise sensors associated with or arranged on rolling stock and further on railway infrastructure like, but not limited to, railway tracks, trackage, permanent ways, electrification systems, sleepers or crossties, tracks, rails, rail-based suspension railways, switches, frogs, point machines, crossings, interlockings, turnouts, masts, signaling equipment, electronic housings, buildings, tunnels, railway stations and/or informational and computational network. Further, the sensor can be associated with or arranged on masts, the roof of a tunnel, etc.

Further, the method can comprise signals that can be gathered from the sensors that can provide information of at least one at least one device, module, model and/or subsystem whose purpose is to detect parameters and/or changes in its environment and provides a respective signal to other devices. Parameters can be length, mass, time, current, electric tension, temperature, humidity, luminous intensity and any parameters derived therefrom such as acceleration, vibration, speed, time, distance, illumination, images, gyroscopic information, acoustics, ultra-sound, air pressure, magnetism, electro-magnetism, position, optical sensor information etc.

The method can further comprise a planning optimization that can be based on at least one analytical approach, each approach can comprise at least one of digital analytical methods, such as filter processing, pattern recognition, statistical analytics, probabilistic analytics, statistical models, principle component analysis, ICA, dynamic time warping, maximum likelihood estimates, modeling, estimating, machine learning, supervised learning, unsupervised learning, reinforcement learning, neural network, convolutional network, deep convolutional network, deep learning, ultra-deep learning, genetic algorithms, Markov models, hidden Markov models, Bayesian scores etc. These analytical methods can be applied alone or any combination thereof, sequentially and/or in parallel. Different analytical approaches can thus be different in the kind of one or more analytical method(s) and/or just the order of a plurality of analytical methods when even using the same methods but just in a different order.

The method can further comprise at least one step of optimizing the planning based on at least one of the current or predicted criteria, that can be asset life cycle, a geophysical location, an operational importance of an asset, a time of the maintenance measure, a complexity of the maintenance measure, a cost of the maintenance measure, traffic information of rolling stack, stock of replacement parts used for the maintenance measure, a safety measure necessary for the maintenance measure, a comfort measure desirable for passengers, budget information, staff availability, load of predicted or scheduled traffic, maintenance vehicle availability and/or tool availability. The asset life cycle is defined as asset health status or asset remaining useful life.

The method can further comprise the step of involving different servers for at least two of the determining maintenance for current technical conditions, determining maintenance of predicted technical conditions and for automatically optimizing the planning. The term "server" can be a computer program and/or a device and/or a plurality of each or both that provides functionality for other programs or devices. Servers can provide various functionalities, often called "services", such as sharing data or resources among multiple clients or performing computation and/or storage functions. A single server can serve multiple clients, and a single client can use multiple servers. A client process may run on the same device or may connect over a network to a server on a different device, such as a remote server or the cloud. The server can have rather primitive functions, such as just transmitting rather short information to another level of infrastructure, or can have a more sophisticated structure, such as a storing, processing and transmitting unit.

It shall be understood that the method can further comprise the step of changing current maintenance planning according to renewed optimization and/or renewed individually determined priority settings.

A further step of the method may comprise providing and receiving feedback of current maintenance and/or repair measures, either an automated feedback or a manual feedback or a combination thereof.

The method can further comprise the step of automatically and/or manual controlling the maintenance planning.

A further example for an advantageous application of the present invention can be to identify a certain vibration as generally coming in combination with a certain movement and associating the two with each other for easier data retrieval/processing. However, the results usually undergo certain analytical approaches, as discussed before and below.

Another example can be a sensor system mounted on a railway sleeper that measures, records, processes and sends acceleration data of various sensitivity, range, resolution, etc. to a remote system. Compared to the state of the art, the aforementioned adaption allows a more energy efficient, wireless, and continuous precise monitoring of the railway. This enables analysis based on a large amount of high quality data which allows novel insights of the railway and railway infrastructure condition and its development unprecedented before. The sensor system data can be usually cleansed and smoothed out (typically using and averaged down sampling process) to improve data quality of a single sensor element. The multiple sensor measurements can be combined by optimal estimation techniques (typically a Kalman Filter variant) to form a qualitatively adequate combined signal.

The term "estimation" is intended to mean a semi-automated, preferably an automated finding of an estimate, or approximation, which is a value that is usable for some purpose even if input data may be large to finding an exact value, incomplete, uncertain, or unstable.

Moreover, the invention can use signal processing and/or methods of machine learning and artificial intelligence (AI) to derive information like vertical movement, vibration, train speed, train type from multiple data sources. Thus, the invention can be able to classify rolling stock categories (high speed, passenger, cargo trains) and to identify types using vendor specific train "footprints" to aggregate an accurate usage statistic and detect specific attributes of a train (e.g. so called "flat wheels") which may induce higher wear and abrasion on the railroad infrastructure. The invention can associate identified trains to schedule maintenance measures to the infrastructure, but also may apply a factor to the life cycle of specific railway infrastructure elements.

The invention can further be able to calculate the accumulated stress which reflects the actual wear of the assets involved. The invention can automatically derive the health condition of the asset bases on the combined data that enables a user to take focused or more precise maintenance activities. The invention can automatically detect anomalies which enables early counter-activities in case of unprecedented failures or wrong asset use and/or can automatically identify the component and the cause of a failure.

A railway planning system for automatically planning maintenance can comprise a determining component for determining maintenance for different assets at different locations comprising a determining component for determining at least one of a predicted technical condition of an asset and an optimization component for automatically optimizing the planning accordingly.

Even further, the invention can predict the future "health condition" of any asset involved. For this, multiple sources to derive a health status that reflects the actual usage of the asset can be used. As an example, the stress and, hence, the wear of the frog (crossing point of two rails) is mainly the result of trains running over it and the temperature changes over time. The invention can make use of the continuously recorded and combined data to derive the stress and to accumulate it over time. In contrast to the state of the art, this stress can be calculated taking into account the train type, speed, vibration power, temperature, direction of travel of each passing train which can reflect much more accurately than a general estimated number of gross tons passing the asset.

The railway planning system can further comprise at least one component for optimizing the planning based on at least one of the current or predicted criteria, like a technical condition of an asset, a degrading effect of rolling stock, traffic load information of rolling stock, maintenance effectiveness metrics and weather information.

The term "optimization" (or optimizing) is intended to comprise the semi-automated, preferably an automate selection of a best available element (with regard to some criterion) from some set of available alternatives. It can be the best value(s) of some objective function given a defined domain (or input), including a variety of different types of objective functions and different types of domains.

The system can further comprise sensors at different geophysical locations wherein the determining component for determining maintenance for different assets is configured to provide information gathered from signals from the sensors.

Further, the information gathered from at least one sensor can be processed by an analyzing component that can comprise at least one analytical approach, each approach comprising at least one of digital analytical methods, such as filter processing, pattern recognition, statistical analytics, probabilistic analytics, statistical models, principle component analysis, ICA, dynamic time warping, maximum likelihood estimates, modeling, estimating, machine learning, supervised learning, unsupervised learning, reinforcement learning, neural network, convolutional network, deep convolutional network, deep learning, ultra-deep learning, genetic algorithms, Markov models, hidden Markov models, Bayesian scores etc. These analytical methods can be applied alone or any combination thereof, sequentially and/or in parallel. Different analytical approaches can thus be different in the kind of one or more analytical method(s) and/or just the order of a plurality of analytical methods when even using the same methods but just in a different order.

The sensors can be associated with or arranged to at least one of the railway infrastructure, like a sleeper, a frog, a point machine, rail frog, a rail blade and/or an interlocking for particularly measuring current at the interlocking.

The signals gathered from the sensor can provide information of at least one of length, mass, time, current, electric tension, temperature, humidity, luminous intensity and any parameters derived therefrom such as acceleration, vibration, speed, time, distance, illumination, images, gyroscopic information, acoustics, ultra-sound, air pressure, magnetism, electro-magnetism, position, optical sensor information etc.

The planning component for optimizing can make use of at least one analytical approach, each approach may comprise at least one of signal filter processing, pattern recognition, probabilistic modeling, Bayesian schemes, machine learning, supervised learning, unsupervised learning, reinforcement learning, statistical analytics, statistical models, principle component analysis, independent component analysis (ICA), dynamic time warping, maximum likelihood estimates, modeling, estimating, neural network, convolutional network, deep convolutional network, deep learning, ultra-deep learning, genetic algorithms, Markov models, and/or hidden Markov models, supervised learning, unsupervised learning and/or reinforcement learning.

The component for optimizing the planning based on at least one of the following current or predicted criteria can comprise asset life, a geophysical location, an operational importance of an asset, a time of the maintenance measure, a complexity of the maintenance measure, a cost of the maintenance measure, traffic information of rolling stock, stock of replacement parts used for the maintenance measure, a safety measure necessary for the maintenance measure, budget information, staff availability, maintenance vehicle availability and tool availability.

The computation component is configured to compute the associated data on the basis of the first and the second analytical data. As discussed, the computation component can be anything that is configured provide the associated data and can comprise local and/or remote components and/or sub-components.

Any component can be configured to process a different analytical approach than another analyzing component. This depends on the properties of the acquired data, their format, their relevance and their accuracy.

Data derived from any sensor as disclosed above can be processed locally, if appropriate. The data can further be pre-processed and then conveyed to a further computational instance for further use and/or can affect signaling, response, warning locally.

Different servers for at least two of the components for determining maintenance for current technical conditions can be comprised. Automation process components may determine maintenance in accordance with the component for determining maintenance of predicted technical conditions and the component for automatically optimizing the planning.

Further, a component for changing current maintenance planning according to renewed optimization can be comprised. Feedback by automated sensors and/or by human input may have influence on re-planning of maintenance measures.

The system according to the present invention can particularly be configured to perform the method discussed above and below. In particular, the system can comprise at least one, preferably a plurality of further sensors for capturing further signals.

The term "railway infrastructure" comprises components or parts thereof on, at, in the vicinity of and/or directed to any railway, such as sleepers or crossties, tracks, rails, switches, frogs, point machines, crossings, interlockings, turnouts, masts, signaling equipment, electronic housings, buildings, tunnels, etc.

The term "sensor" is intended to comprise at least one device, module, model and/or subsystem whose purpose is to detect parameters and/or changes in its environment and provides a respective signal to other devices. Parameters can be length, mass, time, current, electric tension, temperature, humidity, luminous intensity and any parameters derived therefrom such as acceleration, vibration, speed, time, distance, illumination, images, gyroscopic information, acoustics, ultra-sound, air pressure, magnetism, electro-magnetism, position, optical sensor information etc.

The term "different kind of sensor" is intended to mean sensors that are configured to measure different parameters or the same parameters with different technologies. An example for the latter is lasers or induction loops, both provided to measure speed.

The term "analytical approach" is intended to comprise any analytical tool that is used to analyze signals or data. Non-limiting examples are digital analytical methods, such as signal filter processing, pattern recognition, probabilistic modeling, Bayesian schemes, machine learning, supervised learning, unsupervised learning, reinforcement learning, statistical analytics, statistical models, principle component analysis, independent component analysis (ICA), dynamic time warping, maximum likelihood estimates, modeling, estimating, neural network, convolutional network, deep convolutional network, deep learning, ultra-deep learning, genetic algorithms, Markov models, and/or hidden Markov models. These analytical methods can be applied alone or any combination thereof, sequentially and/or in parallel. Different analytical approaches can thus be different in the kind of one or more analytical method(s) and/or just the order of a plurality of analytical methods when even using the same methods but just in a different order.

The term "associated data" is intended to comprise at least two data sets that influence the other. One data set can influence the other data set and/or they influence each other and/or influence the merged data and/or influence data derived from the merged data set. Just accumulated data is not intended to be comprised. Non-limiting examples can be one data set (e.g., comprising train specific data) merged with another data set (e.g., comprising vibration data) provide a result considering both data sets.

The term "server" can be a computer program and/or a device and/or a plurality of each or both that provides functionality for other programs or devices. Servers can provide various functionalities, often called "services", such as sharing data or resources among multiple clients or performing computation and/or storage functions. A single server can serve multiple clients, and a single client can use multiple servers. A client process may run on the same device or may connect over a network to a server on a different device, such as a remote server or the cloud. The server can have rather primitive functions, such as just transmitting rather short information to another level of infrastructure, or can have a more sophisticated structure, such as a storing, processing and transmitting unit.

It should be understood that "maintenance planning" and the expression "maintenance routing" can be used interchangeably. Planning in this context can also comprise the coordination of tools, machines and the further controlling of scheduling of rolling stock.

In the present invention, the expressions "railway infrastructure", "railway network" and similar can be understood interchangeably and can comprise railway tracks, trackage, permanent ways, electrification systems, sleepers or crossties, tracks, rails, rail-based suspension railways, switches, frogs, point machines, crossings, interlockings, turnouts, masts, signaling equipment, electronic housings, buildings, tunnels, railway stations and/or informational and computational network.

A preferred advantage can be the improvement of efficiency with the assignment of tools, spare parts and/or machines. A further preferred advantage can be the reduction of down-time because of failure of components or systems in a railway environment. Down-times can be considerably cost intensive and also reduce the workload.

The present technology is also defined by the following numbered embodiments.

EMBODIMENTS

Figure 1:
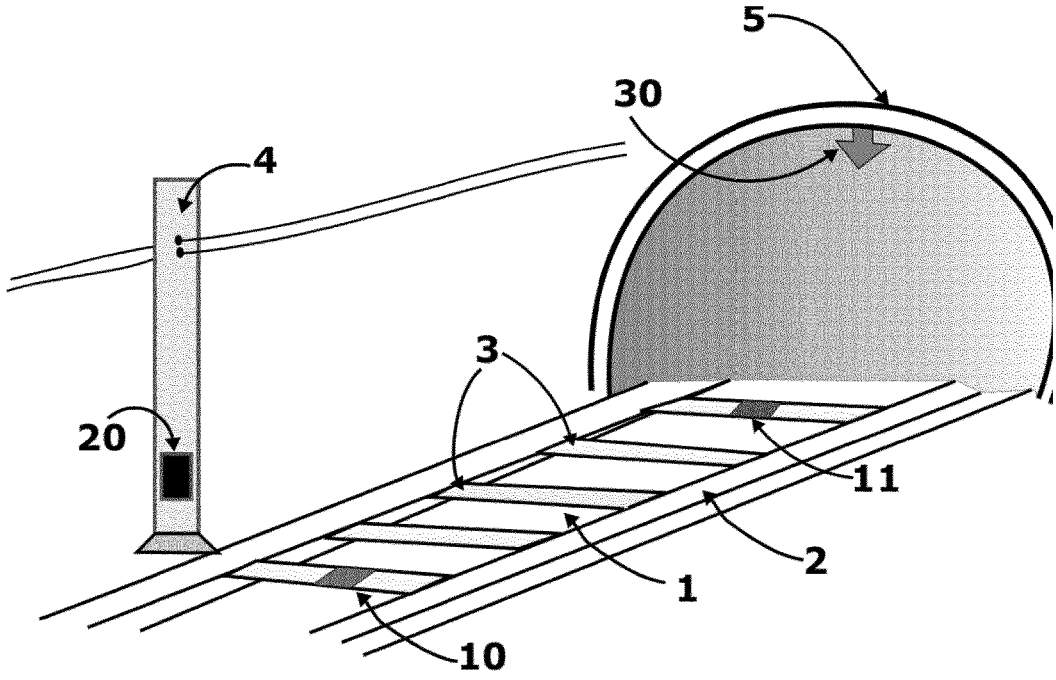
FIG. 1 depicts an example of a set-up of several sensors to a railway infrastructure in accordance with the present invention.

Below, maintenance method embodiments will be discussed. The letter M followed by a number abbreviates the method embodiments. Whenever reference is herein made to method embodiments, these embodiments are meant.

Method

M01: A method for automatically planning maintenance in railway, the method comprising the steps of determining maintenance for different assets at different locations comprising determining at least one of a predicted technical condition of an asset and automatically optimizing the planning accordingly.

M02: The method according to the preceding embodiment with the further step of optimizing the planning based on at least one of the following current or predicted criteria:

a. a technical condition of an asset;
b. a degrading effect of a train;
c. traffic load information of trains;
d. maintenance effectiveness metrics; and
e. weather information.

M03: The method according to the preceding embodiment wherein the determining of maintenance for different assets is based on information gathered from signals from sensors.

M04: The method according to the preceding embodiment wherein the information gathered at least from one sensor is based on at least one analytical approach, each approach comprising at least one of signal filter processing, pattern recognition, probabilistic modeling, Bayesian schemes, machine learning, supervised learning, unsupervised learning and/or reinforcement learning.

M05: The method according to any of the preceding two embodiments wherein the sensors are associated with or arranged at least one of rolling stock, a sleeper, a frog, a point machine, the rail frog, a rail blade and/or an interlocking for particularly measuring current at the interlocking.

M06: The method according to any of the preceding embodiments wherein the signals gathered from the sensor provide information of at least one of temperature, acceleration, vibration, ultra-sound, time, distance, current, pressure, movement, humidity, precipitation and/or acoustics.

M07: The method according to any of the preceding embodiments wherein the planning optimizing is based on at least one analytical approach, each approach comprising at least one of signal filter processing, pattern recognition, probabilistic modeling, Bayesian schemes, machine learning, supervised learning, unsupervised learning and/or reinforcement learning.

M08: The method according to the preceding embodiment with the further step of optimizing the planning based on at least one of the following current or predicted criteria:

a. asset life cycle;
b. a geophysical location;
c. an operational importance of an asset;
d. a time of the maintenance measure;
e. a complexity of the maintenance measure;
f. a cost of the maintenance measure;
g. traffic information of trains;
h. stock of replacement parts used for the maintenance measure;
i. a safety measure necessary for the maintenance measure;
j. budget information;
k. staff availability;
l. maintenance vehicle availability; and
m. tool availability.

M09: The method according to any of the preceding embodiments further comprising the step of involving different servers for at least two of the determining maintenance for current technical conditions, determining maintenance of predicted technical conditions and for automatically optimizing the planning.

M10: The method according to any of the preceding embodiments further comprising the step of changing current maintenance planning according to renewed optimization.

M11: The method according to any of the preceding embodiments further comprising the step of providing and receiving feedback of current maintenance measures.

M12: The method according to any of the preceding embodiments further comprising the step of automatically controlling the maintenance planning.

Below, system embodiments will be discussed. These embodiments are abbreviated by the letter "S" followed by a number. When reference is herein made to a system embodiment, those embodiments are meant.

System

S01: A railway planning system for automatically planning maintenance comprising a determining component for determining maintenance for different assets at different locations comprising a determining component for determining at least one of a predicted technical condition of an asset and an optimization component for automatically optimizing the planning accordingly.

S02: The system according to the preceding embodiment with the further component for optimizing the planning based on at least one of the following current or predicted criteria:

a. a technical condition of an asset;
b. a degrading effect of a train;
c. traffic load information of trains;
d. maintenance effectiveness metrics; and
e. weather information.

S03: The system according to any of the preceding system embodiments further comprising sensors at different geophysical locations wherein the determining component for determining maintenance for different assets is configured to provide information gathered from signals from the sensors.

S04: The system according to the preceding system embodiment wherein the information gathered at least from one sensor is processed by an analyzing component comprising at least one analytical approach, each approach comprising at least one of signal filter processing, pattern recognition, probabilistic modeling, Bayesian schemes, machine learning, supervised learning, unsupervised learning and/or reinforcement learning.

S05: The system according to any of the preceding two system embodiments wherein the sensors are associated with or arranged at least to one of railway infrastructure such as a sleeper, a frog, a point machine, the rail frog, a rail blade and/or an interlocking for particularly measuring point machine current at the interlocking.

S06: The system according to any of the preceding system embodiments wherein the signals gathered from the sensor provide information of at least one of temperature, acceleration, vibration, ultra-sound, time, distance, current, pressure, movement, humidity, precipitation and/or acoustics.

S07: The system according to any of the preceding system embodiments wherein the planning component for optimizing is making use of at least one analytical approach, each approach comprising at least one of signal filter processing, pattern recognition, probabilistic modeling, Bayesian schemes, machine learning, supervised learning, unsupervised learning and/or reinforcement learning.

S08: The system according to the preceding system embodiment with the further component for optimizing the planning based on at least one of the following current or predicted criteria:

a. asset life cycle;
b. a geophysical location;
c. an operational importance of an asset;
d. a time of the maintenance measure;
e. a complexity of the maintenance measure;
f. a cost of the maintenance measure;
g. traffic information of trains;
h. stock of replacement parts used for the maintenance measure;
i. a safety measure necessary for the maintenance measure;
j. budget information;
k. staff availability;
l. maintenance vehicle availability; and
m. tool availability.

S09: The system according to any of the preceding system embodiments further comprising different servers for at least two of the component for determining maintenance for current technical conditions, the component for determining maintenance of predicted technical conditions and the component for automatically optimizing the planning.

S10: The system according to any of the preceding system embodiments further comprising a component for changing current maintenance planning according to renewed optimization.

S11: The system according to any of the preceding system embodiments further comprising a component for providing and receiving feedback of current maintenance measures.

S12: The system according to any of the preceding system embodiments further comprising a component for automatically controlling the maintenance planning.

Whenever a relative term, such as "about", "substantially" or "approximately" is used in this specification, such a term should also be construed to also include the exact term. That is, e.g., "substantially straight" should be construed to also include "(exactly) straight".

Whenever steps are recited in the appended claims, it should be noted that the order in which the steps are recited in this text may be the preferred order, but it may not be mandatory to carry out the steps in the recited order. That is, unless otherwise specified or unless clear to the skilled person, the orders in which steps are recited may not be mandatory. That is, when the present document states, e.g., that a method comprises steps (A) and (B), this does not necessarily mean that step (A) precedes step (B), but it is also possible that step (A) is performed (at least partly) simultaneously with step (B) or that step (B) precedes step (A). Furthermore, when a step (X) is said to precede another step (Z), this does not imply that there is no step between steps (X) and (Z). That is, step (X) preceding step (Z) encompasses the situation that step (X) is performed directly before step (Z), but also the situation that (X) is performed before one or more steps (Y1), . . . , followed by step (Z). Corresponding considerations apply when terms like "after" or "before" are used.

DETAILED DESCRIPTION OF THE FIGURES

FIG. 1 provides a schematic description of a system configured for a railway infrastructure. There is shown an example of a railway section with the railway 1 itself, comprising rails 2 and sleepers 3. Instead of the sleepers 3 also a solid bed for the rails 2 can be provided.

Moreover, a mast 4 is shown that is just one further example of constructional elements that are usually arranged at or in the vicinity of railways. Also a tunnel 5 is shown. It is needless to say that other constructions, buildings etc. can be present and also used for the present invention as described before and below.

A first sensor 10 can be arranged on one or more of the sleepers. The sensor 10 can be an acceleration sensor and/or any other kind of railway specific sensor. Examples have been mentioned before.

A second sensor 11 is also arranged on another sleeper distant from the first sensor 10. Although it seems just a small distance in the present example, those distances can range from the distance to the neighboring sleeper to one or more kilometers. Other sensors can be used for attachment to the sleepers as well. The sensors can further be of different kind—such as where the first sensor 10 may be an acceleration sensor, the second sensor 11 can be a magnetic sensor or any other combination suitable for the specific need. The variety of sensors are enumerated before.

Another kind of sensor 20 can be attached to the mast 4 or any other structure. This could be another sensor, such as an optical, temperature, even acceleration sensor etc. A further kind of sensor 30 can be arranged above the railway as at the beginning or within the tunnel 5. This could be height sensor for determining the height of a train, an optical sensor, a doppler sensor etc. All those sensors mentioned here and before are just non-limiting examples.

Figure 2:
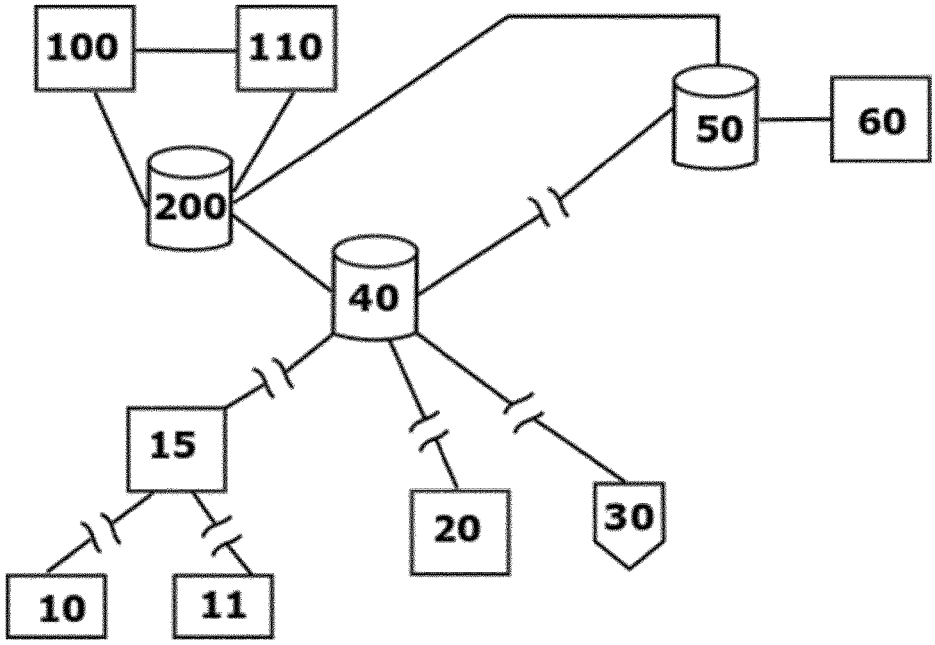
FIG. 2 depicts an example of the set-up of the sensors according to FIG. 1 and associated infrastructure in accordance with the present invention.

FIG. 2 is intended to provide an example for a hardware/software infrastructure that can vary for different needs. Sensors 10 and 11 can be connected to a common component 15, such as a server 15, with the functions like transmitting, storing, resending and/or processing etc.). All sensors 10, 11, 20, 30 could additionally or alternatively be connected to another server or storage 40 that is collecting the data, storing and transmitting it. In the latter case server 15 can be regarded as a pre-processing unit, a data collection unit, a filtering or calibrating unit.

In the example shown, the data is further submitted (pushed and/or pulled) to a remote server 50, a plurality of servers 50, 60, cloud computing, cloud storages etc. regularly or unregularly upon need. These components may be used for more sophisticated computing, as for example used for training a neural network.

Any transmission between the sensors, other components, such as servers etc., can be hard-wired and/or wireless, depending on the needs and the further infrastructure.

All sensors 10, 11, 20, 30 may further be used for traffic control, security reasons, source for billing purposes etc. and the data may further be copied for maintenance purposes, be the purpose predictive, precautionary or due to an exceptional value that may cause immediate or quick reaction by the maintenance team.

Server 200 can be a working server for the maintenance team. In the embodiment, server 200 is connected to server 40 and/or to server 50. Server 200 can be configured to collect further data from the network that may comprise availability information of team members at maintenance entity 100 and/or from a spare parts entity 110.

The sensors may contribute their values to a local network, as explained before, that can be connected wirelessly or wired. Further, local read-outs may be accomplished and initiate a signaling, a forced braking or any other measure. Further, the read-out value can be disregarded, for instance, if the sensor is intended to detect exceptional values only. Also, the server 15 or any other server in the hierarchy or the network (40, 50) may disregard single or a plurality of signals or apply a weighting in the sense of weighing the relevance.

Figure 3:
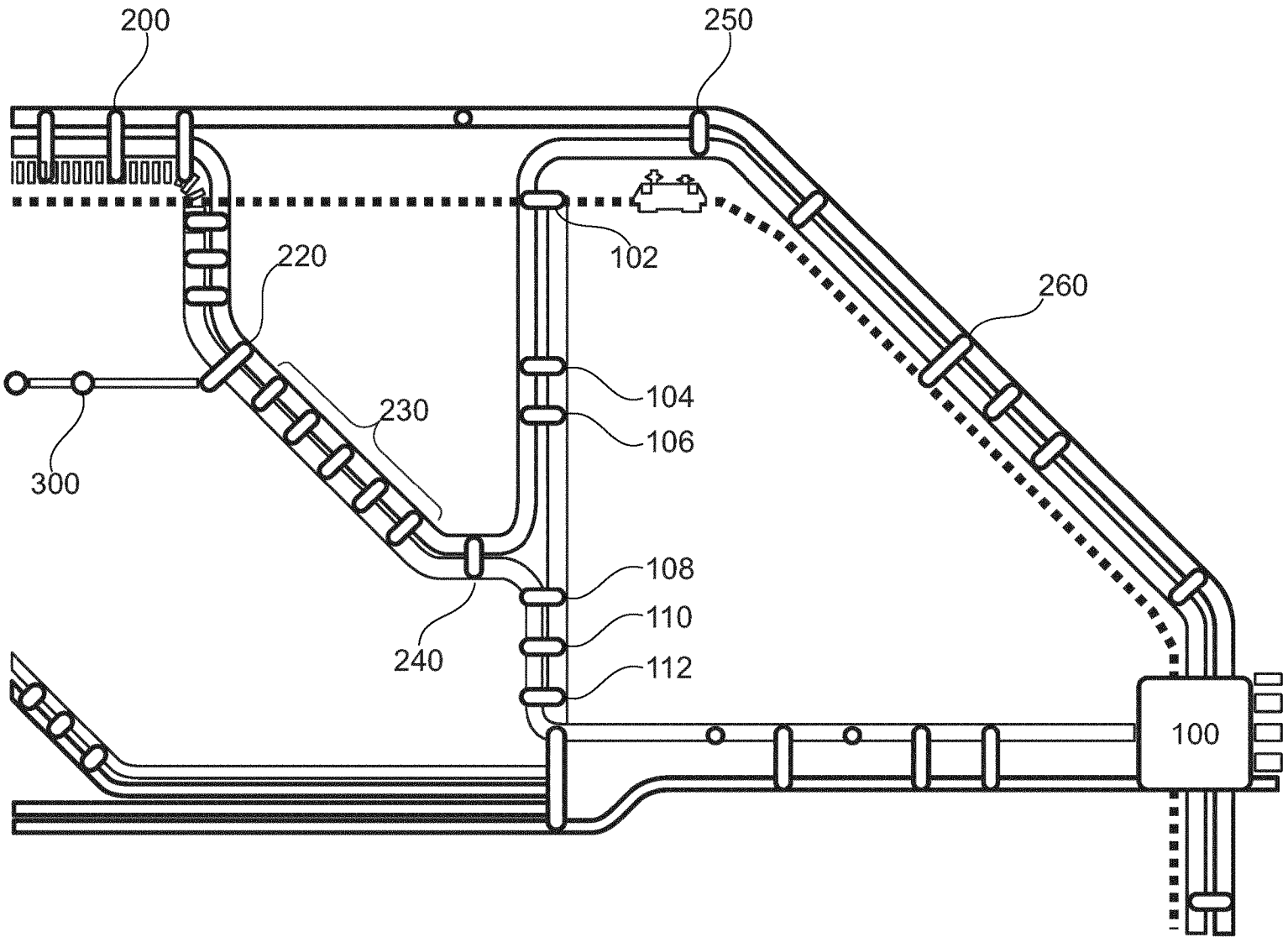
FIG. 3 depicts a portion of a railway infrastructure with various dislocation of sensors and different available maintenance options.

FIG. 3 depicts an exemplary extraction of a real railway network. An irregular condition may have been detected at sensor or device 110; a sensor or device of the same make in this embodiment is found at location 106. Further, a switch or a component of the switch 240 is close to an end to its asset life cycle.

Further, not depicted, a similar sensor or device like the one at 110 or 106 can be at a remote location or even another entity. The method according to the invention can then alert a supervising or remote database about a concern that may arise based on the determination of the reason for a malfunction, should this be based in a manufacturing failure or any other principal failure (wrong application for instance).

The method and system of the invention will determine the necessity to at least check for the reason and the effort to be taken to initiate a repair and/or maintenance measure at sensor or device 110.

The method according to the invention will inform a railway operation administrator that the lane located between location 108 and 112 must be closed for the maintenance down time. This allows the operations coordinator (not depicted) to organize all measures necessary to get a train at station 200 to the main station 100. Although this train would in normal conditions travel along locations 220, 230, 240 further via 108, 110 and 112 to main station 100. However, because the lane passing sensor or device 110 will have to be closed, the operations coordinator may announce and schedule a rerouting via 220, 230, 240, 106, 104, 102, 250 and 260 to the main station 100.

The maintenance planning system may determine that however that switch 240 should also be replaced or applied a maintenance measure to. In such a case, the operation administrator would have to even reroute the train at location 200 via 250 and 260 to the main station 100, at least during the time that switch 240 is inoperative due to maintenance measures.

The maintenance planning scheme may schedule—in dependency of the priority needed—predictively may be included into the maintenance mission sent to sensor or device 110. Sensor or device 108 and 112 may receive a priority for precautionary maintenance measure, because, first, the maintenance resource is anyhow located close to these two sensors or devices. Further, the corresponding lane must be closed anyhow, such the affect on the operations of trains may be less than if the lane would have to be closed down later.

During the transfer of the maintenance resources from workshop 300 to the lane that is closed to the general train traffic to apply maintenance measures to the sensors or devices 108, 110 and 112, the method according to the invention will coordinate with the scheduled train traffic and the operation manager to keep the path for the maintenance machine available from workshop 300 via 220, 230 and 240 to the location of actual activity open.

The method according to the invention will further, after having carried out the maintenance measures at locations 110, 112 and 108, return into the direction of workshop 300, however have in mind that the switch 240 also needs some work to be done. Thus, in coordination with the operations coordinator initiate the closure of the whole part of the infrastructure, here depicted with the numerals 220, 230, 240, further 106, 104 and 102. Note, the portion where sensors or devices 108, 110 and 112 are located, can be released for a pendular traffic of trains between the main station 100 and sensor or device 108 (which could be a small station).

After having repaired the switch 240 or the component of the switch 240 that had to be maintenance, the machine can be sent to sensors 102, 104 and 106 to carry out whatever measures are necessary or precautionary serviced. Note, in this case, the branch from station 200 via 220, 230, 240, 108, 110, 112 to main station 100 can be released to the operations coordinator.

After having completed all work that has been assigned by the inventive method and system, the machine has to return to the workshop, in this embodiment. This return way can be assigned a smaller priority, if no imminent works are scheduled by the maintenance planning system.

The necessity of maintenance measures or their usefulness may be determined via use of machine learning methods like an artificial neural network that can be trained locally and/or remotely. As one result of the train type classification and the prior list of train types the invention calculates the speed and accumulates the vibration energy of the recorded data from a train passage. Such information, that was not available continuously in the state of the art and therefore could not be used for condition monitoring and prediction, can be used as a basis for the decision, where and when maintenance measures are meaningful.

The subject matter of the invention also uses data from multiple sensors at one asset to separate different origins of recorded signals via different signal processing methods or analytical approaches. In this example a train runs over three succeeding sensor systems at one asset and an independent component analysis is used to separate noise from train borne signals and from asset borne signals. Such an information gained from these detections may let the necessity of maintenance measures appear more or less likely. A heavy train obviously can consume more resources than a small train, a trolley may use less resources than a fast-speed train.

The information derived in previous steps can be used to detect anomalies, provide a health condition conclusion, diagnose a failing component, and/or predict a condition development trend.

The boundaries for normal behavior are pre-set, automatically set and/or set via machine learning methods (like by support vector machines). The anomaly lies outside the boundary but it does not resemble known failure. Compared to the state of the art in which such derived models are not possible the invention can reduce uncertainty and enable automated anomaly detection with higher accuracy. The invention can use the information to identify patterns related to failure modes of the ballast or the geometry, here the unsupported sleepers or surface failures of rails. Such pattern is formed by single values that directly reveal a failure or intolerable condition like the certain vertical movement at a certain speed and train type. Alternatively, or additionally, such patterns are present in the frequency and time domain of measured and combined data and transformed via signal processing methods such as Fourier Transformation or Wavelet Transformation. Machine learning classification methods like artificial neural networks are used to identify the class of the defect (here a crack) and/or the component (here the frog) and/or the location (here the tip of the frog). Compared to the state of the art in which dedicated temporal measurement devices are used to execute a certain measurement the invention derives multiple condition assessments from one or multiple sources using one or more ranges of the signals.

The invention claimed is:

1. A method for automatically planning maintenance in railway infrastructure, the method comprising the steps of:

(a) determining maintenance for different assets at different locations comprising determining a predicted technical condition of an asset and (b) automatically optimizing the planning accordingly, wherein the optimizing of the planning is based on a degrading effect of a train, maintenance effectiveness metrics and current or predicted traffic information of trains;

wherein the optimizing of the planning is based on at least one analytical approach;

wherein each analytical approach comprises at least one of signal filter processing pattern recognition, probabilistic modelling, Bayesian schemes, machine learning, supervised learning, unsupervised learning and reinforcement learning, and wherein the asset whose technical condition is predicted comprises one or more switches.

2. The method according to claim 1 with the further step of optimizing the planning based on at least one of the following current or predicted criteria:

a technical condition of an asset;

traffic load information of trains; and weather information.

3. The method according to claim 1 wherein the determining of maintenance for different assets of a railway infrastructure is based on information gathered from signals from sensors.

4. The method according to claim 3 wherein the sensors are associated with or arranged on/at/in at least one of an asset of railway infrastructure and/or a rolling stock.

5. The method according to claim 1 wherein the signals gathered from the sensor provide information related to acceleration.

6. The method according to claim 1 with the further step of optimizing the planning based on at least one of the following current or predicted criteria:

asset life cycle;

a geophysical location;

an operational importance of an asset;

a time of the maintenance measure;

a complexity of the maintenance measure;

a cost of the maintenance measure;

stock of replacement parts used for the maintenance measure;

a safety measure necessary for the maintenance measure;

budget information;

staff availability;

maintenance vehicle availability; and tool availability.

7. The method according to claim 1 further comprising the step of involving different servers for at least two of the determining maintenance for current technical conditions, determining maintenance of predicted technical conditions and for automatically optimizing the planning.

8. The method according to claim 1 further comprising the step of automatically controlling the maintenance planning.

9. The method according to claim 1 further comprising the step of changing current maintenance planning according to renewed optimization.

10. The method according to claim 1 further comprising the step of providing and receiving feedback of current maintenance measures.

11. A railway planning system for automatically planning maintenance comprising (a) a determining component for determining maintenance for different assets at different locations comprising a determining component for determining a predicted technical condition of an asset and (b) an optimization component for automatically optimizing the planning accordingly, wherein the optimization component performs the optimizing of the planning based on a degrading effect of a train, maintenance effectiveness metrics and current or predicted traffic information of trains;

wherein the optimizing of the planning is based on at least one analytical approach;

wherein the information gathered at least from one sensor is processed by an analyzing component comprising at least one analytical approach;

wherein each analytical approach comprises at least one of the signal filter processing pattern recognition, probabilistic modelling, Bayesian schemes, machine learning, supervised learning, unsupervised learning and reinforcement learning; and wherein the asset whose technical condition is predicted comprises one or more switches.

12. The system according to claim 11 with the further component for optimizing the planning based on at least one of the following current or predicted criteria:

a technical condition of an asset;

traffic load information of trains; and weather information.

13. The system according to claim 11 further comprising sensors at different geophysical locations wherein the determining component for determining maintenance for different assets is configured to provide information gathered from signals from the sensors.

14. The system according to claim 11 wherein the sensors are associated with or arranged at least on/or/at one of a railway infrastructure and/or rolling stock.

15. The system according to claim 11 wherein the signals gathered from the sensor provide information of acceleration.

16. The system according to claim 11 with the further component for optimizing the planning based on at least one of the following current or predicted criteria:

asset life cycle;

a geophysical location;

an operational importance of an asset;

a time of the maintenance measure;

a complexity of the maintenance measure;

a cost of the maintenance measure;

stock of replacement parts used for the maintenance measure;

a safety measure necessary for the maintenance measure;

budget information;

staff availability;

maintenance vehicle availability; and tool availability.

17. The system according to claim 11 further comprising different servers for at least two of the component for determining maintenance for current technical conditions, the component for determining maintenance of predicted technical conditions and the component for automatically optimizing the planning.

* * * * *